United States Patent [19]

Kageyama

[11] 4,258,286

[45] Mar. 24, 1981

[54] COUPLED CAVITY TYPE TRAVELING WAVE TUBE

[75] Inventor: Takao Kageyama, Tokyo, Japan

[73] Assignee: Nippon Electric Co., Ltd., Tokyo, Japan

[21] Appl. No.: 57,348

[22] Filed: Jul. 13, 1979

[30] Foreign Application Priority Data

Jul. 14, 1978 [JP] Japan ..... 53/86252

[51] Int. Cl.[3] ..... H01J 25/34

[52] U.S. Cl. ..... 315/3.6; 315/3.5; 315/37.3

[58] Field of Search ..... 315/3.6, 3.5, 39.3

[56] References Cited

U.S. PATENT DOCUMENTS

| | | | |
|---|---|---|---|
| 2,760,161 | 8/1956 | Cutler | 315/3.6 X |
| 2,956,200 | 10/1960 | Bates | 315/3.6 |
| 3,544,832 | 12/1970 | Brous | 315/3.6 |
| 3,832,593 | 8/1974 | Gross | 315/3.6 |
| 3,852,635 | 12/1974 | Heynisch | 315/3.6 |
| 4,001,630 | 1/1977 | Gross | 315/3.6 |
| 4,019,087 | 4/1977 | Hamada et al. | 315/3.6 |
| 4,147,956 | 4/1979 | Horigome et al. | 315/3.6 |

*Primary Examiner*—Saxfield Chatmon, Jr.

*Attorney, Agent, or Firm*—Fitzpatrick, Cella, Harper & Scinto

[57] ABSTRACT

A coupled cavity type traveling wave tube wherein selected matching and main cavities in the tube are provided with a layer of high resistance metal to minimize generation of reflected waves and thereby to achieve stable operation with high efficiency.

4 Claims, 3 Drawing Figures

COUPLED CAVITY TYPE TRAVELING WAVE TUBE

BACKGROUND OF THE INVENTION

This invention relates to a coupled cavity type traveling wave tube, and especially an attenuator to be provided in slow-wave circuits thereof.

A coupled cavity type traveling wave tube serves as a source of high power in microwaves and millimeter waves frequency band and thus is widely used as an output tube in the earth station for satellite communication.

To minimize possible intermodulation, most of the traveling wave tubes currently employed in circuits of large-capacity and high-performance communication such as satellite communication are operated in a region of high linearity, that is, in a small signal operation range where the output power level of the tube is low, so that the small signal gain versus frequency characteristic is an important factor for performance of the tube. However, the coupled cavity type traveling wave tube has a disadvantage that its small signal gain vs. frequency characteristic involves considerable degree of ripple as compared with that of a helix type traveling wave tube. Such ripple appearing in the small signal gain vs. frequency characteristic is caused by a reflected wave produced in the slow-wave circuit of the tube. A coupled cavity type slow-wave circuit develops a reflected wave more readily than a helix slow-wave circuit because of considerable variation in the characteristic impedance at the points where it is connected to an input waveguide and to an output waveguide as well as at the points where main cavities are coupled to matching cavities. A larger reflected wave causes not only greater gain ripple but also oscillation at a frequency where the positive feedback loop gain is above a value of 1. A coupled cavity type traveling wave tube according to the prior art technique has achieved stable operation with the aid of what is called a sever attenuator which severs the slow-wave circuit into sections of an input slow-wave circuit, intermediate slow-wave circuit and an output slow-wave circuit for complete isolation of propagation of circuit waves from one section to another. The purpose of using of this attenuator is to divide the slow-wave circuit into sections for suppressing the loop gain of each section down to a level smaller than 1 as well as for minimizing possible oscillations and gain ripple.

Severing the slow-wave circuit into a plurality of sections is very effective for achieving stable operation of the tube so long as the purpose is prevention of oscillation, but on the other hand, it has caused other troublesome effects in that reflected waves produced in the severed sections adversely affect the tube in such a manner that the resulting gain ripple reaches a noticeable level.

SUMMARY OF THE INVENTION

It is therefore one object of this invention to provide a coupled cavity type traveling wave tube which is free from oscillation, causes only small gain ripple, achieves stable operation, and has handling capabilities of high power without lowering the gain and the efficiency.

It is another object of this invention to provide a coupled cavity type traveling wave tube which has a slow-wave circuit severed into a plurality of sections, causes only small gain ripple, achieves stable operation and can be manufactured at low cost simply by coating predetermined ones of cavities of the slow-wave circuit with a high-resistance attenuating material without changing the profile or construction of the tube.

This invention provides a coupled cavity type traveling wave tube comprising a plurality of slow-wave circuits or sections along the path of an electron beam, each circuit or section including one or more matching cavities disposed at both ends thereof and two or more main cavities interposed between the matching cavities, characterized in that the inner walls of a limited number of the cavities, that is, at least one matching cavity at each end of an imput or pre-stage slow-wave circuit, a matching cavity at the end on the side of an electron gun of an output slow-wave circuit and not more than half of the main cavities of the output slow-wave circuit, are coated with a layer of high-resistance metal such as iron preferably, stainless steel or nickel which can absorb reflected high frequency waves. It is to be understood that either the whole or partial area of the inner wall of a cavity may be coated with such layer of high-resistance metal. The travelling wave tube of this invention is free from oscillation, has only small gain ripple, and achieves stable operation with high efficiency, as compared with those in which all the cavities of the slow-wave circuits are coated with a high-resistance metal and those in which the inner walls of only the main cavities are coated with such metal.

The characteristic impedance at input and output ends of the slow-wave circuit of the coupled cavity type traveling wave tube generally decreases (accompanied by rippling) with increase in frequency, whereas the characteristic impedance of the input and output waveguides or the sever terminating waveguide decreases linearly as the frequency increases. The occurrence of reflected waves due to the difference in characteristic impedance between the slow-wave circuit and each waveguide can be minimized by the provision of a matching cavity, having a layer of high-resistance metal formed on its inner walls, at each end of the slow wave circuit.

Generation of reflected waves at points where a matching cavity is coupled to a main cavity having different characteristic impedance can be minimized by a layer of high-resistance metal provided on the inner wall of a main cavity adjacent to the matching cavity.

By using a thicker or larger layer of high-resistance metal or increasing the resistivity of such metal for a cavity closer to either end of each section of the slow-wave circuit, even reflected waves occurring between a lossy cavity coated with such high-resistance metal layer and a lossless cavity can be eliminated, thus providing complete impedance matching. Therefore, according to this invention, a cavity having its inner walls coated with a layer of high-resistance metal is disposed near the source of reflected waves within the slow-wave circuit so as to achieve immediate attenuation of the reflected waves produced, thus preventing them from being propagated a long distance along the slow-wave circuit. By so doing, any effect of the reflected waves on the traveling wave induced by the electron beam is minimized with the resulting advantage of small gain ripple.

DETAILED DESCRIPTION OF PREFERRED EMBODIMENTS

Figure 1:
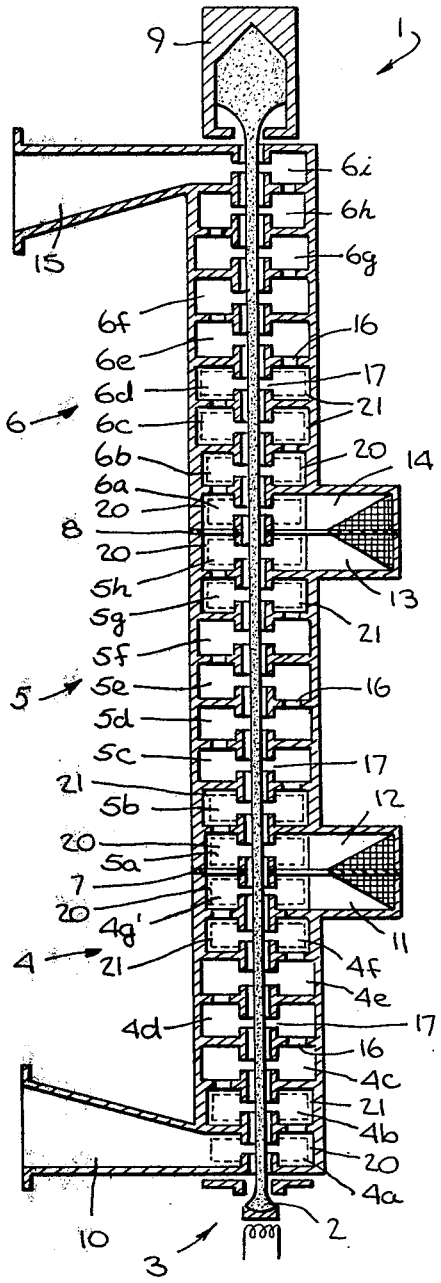
FIG. 1 is a longitudinal sectional view of a coupled cavity traveling wave tube according to one embodiment of this invention.

This invention will hereunder be described in detail by reference to the accompanying drawings. FIG. 1 illustrates one embodiment of a coupled cavity type traveling wave tube incorporating the features of this invention, wherein a tube 1 comprises an electron gun 3 for generating and projecting an electron beam 2, slow-wave circuit means comprising an input section or circuit 4, intermediate section or circuit 5 and an output section or circuit 6 formed along the path of electron beam, a first sever section or circuit 7 and second sever section or circuit 8 for preventing coupling of circuit waves between these sections of the slow-wave circuit means, and a collector electrode 9 disposed at the terminating end of the path of electron beam.

The input slow-wave circuit 4 comprising matching cavities **4*a* and 4*b* disposed at end of the circuit and 4*f* and 4*g* at the other end of the circuit, plus three main cavities 4*c*, 4*d* and 4*e* interposed between matching cavities 4*b* and 4*f*. A total of seven cavities 4*a* thru 4*g* are electromagnetically coupled to each other through a coupling hole 16 provided in each partition wall for individual cavities. One end of the circuit 4 is connected to an input waveguide 10, and the other end to a sever terminating waveguide 11**.

The intermediate slow-wave circuit 5 comprises matching cavities **5*a*, 5*b* disposed at one end of the circuit and 5*g*, 5*h* at the other end, plus four main cavities 5*c*, 5*d*, 5*e* and 5*f* interposed between matching cavities 5*b* and 5*g*. A total of eight cavities are electomagnetically coupled with each other in a similar manner to the input slow-wave circuit 4. One end of the circuit 5 is connected to a sever terminating waveguide 12, and the other end to a sever terminating waveguide 13**.

The output slow-wave circuit 6 comprises a total of nine cavities two pairs of matching cavities **6*a*, 6*b* and 6*h* and 6*i* disposed at opposite ends of the circuit plus five main cavities 6*c*, 6*d*, 6*e*, 6*f* and 6*g* interposed between matching cavities 6*b* and 6*h* which are coupled with each other in the same manner as the circuit 4. One end of the circuit 6 is connected to a sever terminating waveguide 14, and the other end to an output waveguide 15**.

To match the characteristic impedance of each waveguide and main cavities in each slow-wave circuit, the matching cavities have a higher resonant frequency for $TM_{010}$ mode than the main cavities to provide a wider passband for the matching cavities in $TM_{010}$ cavity mode. In addition, the inner walls of the matching cavities **4*a*, 4*g*, 5*a*, 5*h*, 6*a* and 6*b* are coated with a layer 20 of stainless steel asa high-resistance metal, whereas the inner walls of the matching cavities 4*b*, 4*f*, 5*b* and 5*g* and the main cavities 6*c* and 6*d* are coated with a layer 21** of nickel as a high-resistance metal.

An input high-frequency signal fed into the input slow-wave circuit 4 through the input waveguide 10 induces a traveling wave electric field across interaction gaps 17. The traveling wave density-modulates an electron beam 2 flowing at a rate substantially the same as the phase velocity of the traveling wave, and at the same time, the traveling wave increases its amplitude by absorbing kinetic energy of the electron beam and eventually enters in the sever terminating wave-guide 11. On the other hand, the electron beam 2 density-modulated in the input slow-wave circuit 4 induces an electric field of traveling wave in the intermediate slow-wave circuit 5, so that the electron beam 2 is further strongly density modulated by interaction with this traveling wave and eventually enters in the output slow-wave circuit 6, where traveling wave electric field having a further increased amplitude is induced.

The traveling wave induced further absorbs the kinetic energy of the electron beam 2, and after its amplitude has been increased, it is sent through the output waveguide 15 to an external circuit (not shown) as a high-frequency signal. If the effect of reflected waves on each slow-wave circuit is negligible, the high-frequency signal extracted to the external circuit has a constant gain versus frequency characteristic which is determined by the synchronizing relationship between the traveling wave and electron beam. However, if a reflected wave produced at junctions between the waveguide sections and slow-wave circuits is propagated along the slow-wave circuits, its is added vectorially to the traveling wave induced by the electron beam 2, thus causing rippling to appear in the gain versus frequency characteristic. To avoid this disadvantage, according to the embodiment of FIG. 1, the inner walls of the matching cavities **4*a*, 4*g*, 5*a*, 5*h*, 6*a* and 6*b* are coated with the layer 20 of stainless steel as a high-resistance metal and the inner walls of the matching cavities 4*b*, 4*f*, 5*b* and 5*g* plus main cavities 6*c* and 6*d* are coated with the layer 21 of nickel as a high-resistance metal, which layers 20 and 21 rapidly attenuate any reflected wave produced at junctions between the waveguide sections and the slow-wave circuits. At the same time, by increasing the resistivities of the layers of high-resistance metal as a function of the longitudinal distance from either end of each slow-wave circuit, any reflected wave produced at junctions between lossy cavities and lossless cavities can be suppressed, thus minimizing the effect of the reflected wave on the traveling wave induced by the electron beam 2**.

In the embodiment of FIG. 1, the output slow-wave circuit 6 differs from the input slow-wave circuit 4 and intermediate slow-wave circuit 5 in that the inner walls of the main cavities **6*c* and 6*d*, but not the matching cavities 6*h* and 6*i* at the output end, are coated with a layer of high-resistance metal. The reason is: the microwave in the output slow-wave circuit 6 by the interaction with the electron beam has been amplified to high power and becomes stronger than in the two other slow-wave circuits in such a manner that it provides maximum power output in the matching cavity 6*i* coupled to the output waveguide 15 or the matching cavity 6*h* immediately up-stream of the cavity 6*i*. Therefore, if a layer of high-resistance metal is coated onto the matching cavity 6*i* or 6*h*, it will absorb the microwave power and generate heat which must be eliminated by provision of separate cooling means. To avoid such disadvantage, no layer of high-resistance metal is coated on the matching cavities 6***h* and 6*i*.

But on the other hand, there is a possibility of oscillation caused by the reflected wave from the output end of the output slow-wave circuit 6, and so, the inner walls of the main cavities 6*c* and 6*d* are coated with the layer 21 of nickel which reduces the gain and prevents the occurrence of oscillation.

Figure 2:
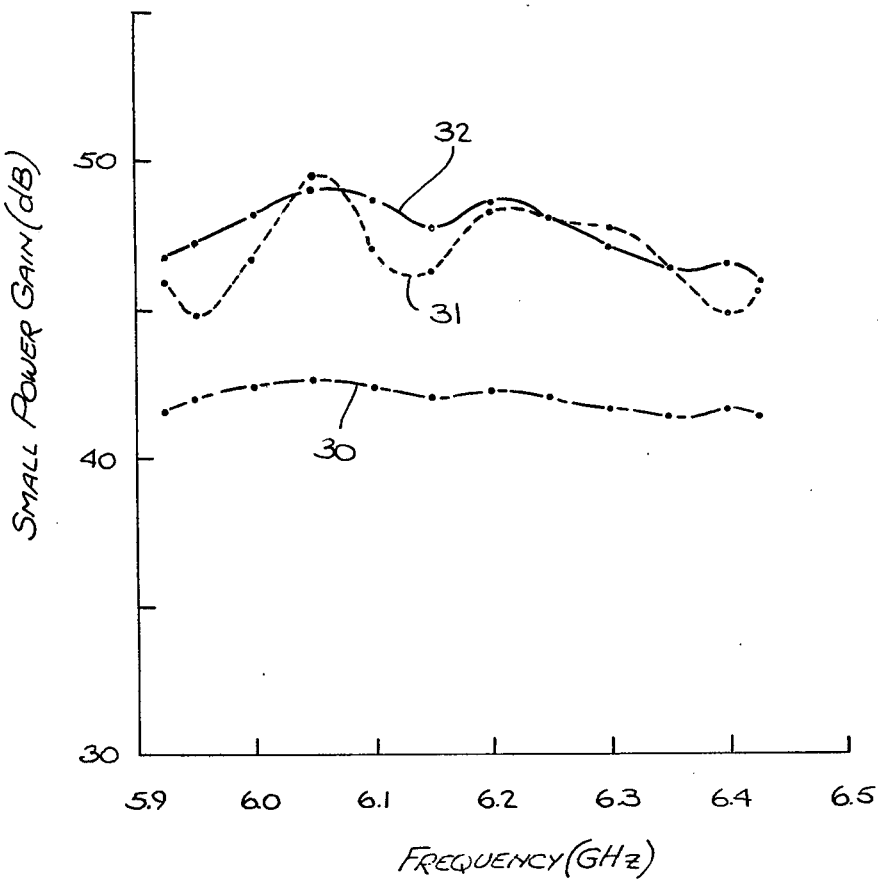
FIG. 2 is a graph showing the frequency versus small signal power gain relationships of three different arrangements of the layer of high-resistance metal coated on the cavities.

FIG. 2 shows the small signal power gain versus frequency characteristic profile of the traveling wave tube illustrated in the embodiment of FIG. 1 as compared with the tube wherein all cavities in the slow-wave circuits are coated with a layer of high-resistance metal as well as the tube wherein only main cavities are coated with such layer. In FIG. 2, a curve 30 indicates the characteristic of the tube which has all main and matching cavities are coated with a layer of high-resistance metal, a curve 31 the characteristic of the tube which has only the main cavities coated with such layer to provide a distributed loss, and a curve 32 the characteristic of the tube of this invention wherein predetermined ones of matching the cavities are coated with the metal layer as described by reference to FIG. 1. As is clear from FIG. 2, the tube which has all cavities coated with a layer of high-resistance metal causes slight gain rippling but it also delivers low power gain and therefore is disadvantageous as a commercial product. An attempt at increasing the power gain by coating the metal layer only on the main cavities results in increased gain rippling and impairs the stability of the operation of the tube. In contrast, the traveling wave tube of this invention illustrated in FIG. 1 wherein only predetermined ones of matching cavities are coated with the metal layer features good characteristic with high power gain and small gain rippling.

Figure 3:
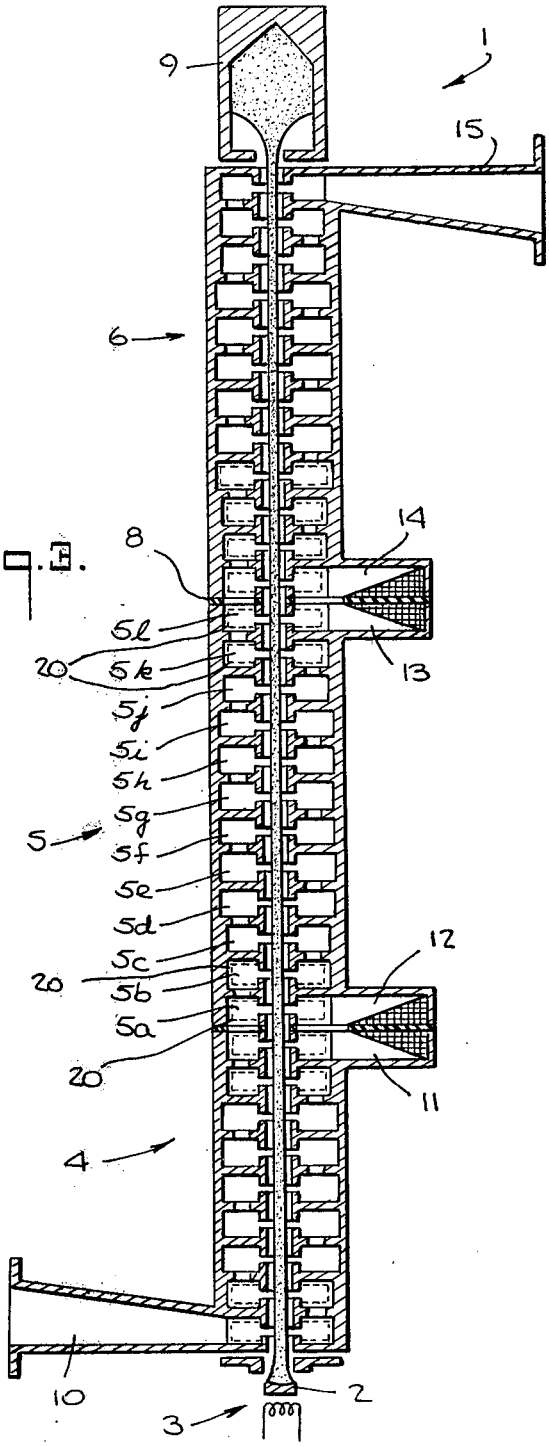
FIG. 3 is a longitudinal sectional view of a coupled cavity traveling wave tube employing a different number of matching and main cavities than the tube according to the embodiment of FIG. 1.

FIG. 3 illustrates another embodiment of the coupled cavity type traveling wave tube according to this invention. In FIG. 3, the input slow-wave circuit 4, the intermediate slow-wave circuit 5 and the output slow-wave circuit 6 have five, six and seven main cavities, respectively, and the intermediate and output slow-wave circuits each have three matching cavities. The inner walls of the matching cavities of the slow-wave circuits 4, 5 and 6 are coated with the layer 20 of high-resistance metal. The arrangement shown in FIG. 3 provides a traveling wave tube having a small signal power gain versus frequency characteristic as good as the tube illustrated in FIG. 1 that produces a high power gain with small rippling.

While stainless steel and nickel are employed in the above illustrated two embodiments as the high-resistance metal that constitutes the layer which covers the inner walls of predetermined ones of cavities, it is to be understood that only one of them or other suitable material may be used. It is also to be understood that the illustrated embodiments in no way limit the number of the main cavities and matching cavities that constitute each slow-wave circuit. In addition, all matching cavities need not to be coated with the layer of high-resistance metal. Further in addition, the number of main cavities coated with the layer of high - resistance metal for the purpose of preventing oscillation in the upstream side of the output slow-wave circuit 6 is not limited to two as in the illustrated embodiments and should be determined by the gain of said circuit. However, it is emphasized that not more than half of the main cavities used in the output slow-wave circuit should be coated with such layer of high - resistance metal; otherwise, a decrease in the gain of the slow-wave circuit will result.

What we claim is:

1. A coupled cavity type traveling wave tube comprising an electron gun for projecting an electron beam along a path at least one input slow-wave circuit and an output slow-wave circuit arranged along said electron beam path, each of said slow-wave circuits including at least one matching cavity disposed at one end of the respective circuit, at least one matching cavity disposed at the other end of the respective circuit and at least two main cavities interposed between said matching cavities, said tube further comprising a layer of high resistance metal coating at least a portion of the inner walls of at least one matching cavity at opposite ends of said input slow-wave circuit, at least a portion of the inner walls of a matching cavity at the end closer to the electron gun of said output slow-wave circuit and at least a portion of the inner walls of half or less of the main cavities adjacent to said matching cavity of said output slow-wave circuit.

2. A coupled cavity type traveling wave tube according to claim 1 wherein the layer of high resistance metal is thickest at the cavity at either end of each circuit and becomes thinner at cavities farther said ends.

3. A coupled cavity type traveling wave tube according to claim 1 or 2 wherein said layer of high resistance metal is made of nickel.

4. A coupled cavity type traveling wave tube according to claim 1 or 2 wherein said layer of high resistance metal is made of steel.

* * * * *

UNITED STATES PATENT AND TRADEMARK OFFICE

CERTIFICATE OF CORRECTION

PATENT NO. : 4,258,286

DATED : March 24, 1981

INVENTOR(S) : Takao Kageyama

It is certified that error appears in the above—identified patent and that said Letters Patent is hereby corrected as shown below:

Column 3, line 32, after "at" insert -- one --;

line 67, "asa" to read -- as a --;

Column 4, line 32, "its" to read -- it --.

Signed and Sealed this

*Eleventh* Day of *August 1981*

[SEAL]

*Attest:*

GERALD J. MOSSINGHOFF

*Attesting Officer*

*Commissioner of Patents and Trademarks*